US006488518B2

(12) United States Patent
Mlyniec

(10) Patent No.: US 6,488,518 B2
(45) Date of Patent: Dec. 3, 2002

(54) SQUIBB ELECTRONIC CONNECTOR

(75) Inventor: Kenneth P. Mlyniec, Keokuk, IA (US)

(73) Assignee: Methode Electronics Inc., Chicago, IL (US)

( * ) Notice: Subject to any disclaimer, the term of this patent is extended or adjusted under 35 U.S.C. 154(b) by 0 days.

(21) Appl. No.: 09/824,472

(22) Filed: Apr. 2, 2001

(65) Prior Publication Data

US 2002/0142639 A1 Oct. 3, 2002

(51) Int. Cl.[7] ..... H01R 13/62
(52) U.S. Cl. ..... 439/180; 439/155; 439/923; 439/352
(58) Field of Search ..... 439/923, 489, 439/488, 140, 141, 152, 155, 357, 350, 156, 160, 352

(56) References Cited

U.S. PATENT DOCUMENTS

| | | | | | |
|---|---|---|---|---|---|
| 3,210,717 | A | * | 10/1965 | Brown | 439/141 |
| 3,678,441 | A | * | 7/1972 | Upstone et al. | 439/141 |
| 5,529,512 | A | * | 6/1996 | Mlyniec | 439/352 |
| 6,206,717 | B1 | * | 3/2001 | Matsumoto | 439/923 |

* cited by examiner

*Primary Examiner*—Gary F. Paumen
*Assistant Examiner*—Felix O Figueroa
(74) *Attorney, Agent, or Firm*—Seyfarth Shaw

(57) ABSTRACT

An electrical connector that includes a disengagement member is provided. The disengagement member is utilized to ensure that the electrical connector is secured in a locked position within a mating receptacle. This effectively eliminates disengagement of the electrical connector from the mating receptacle during regular use, such as that relating to an airbag squib connector.

20 Claims, 2 Drawing Sheets

SQUIBB ELECTRONIC CONNECTOR

BACKGROUND OF THE INVENTION

1. Field of the Invention

The present invention generally relates to electrical connectors that include disengagement members. More specifically, the present invention relates to electrical connectors for use as an automobile airbag squib connector that include disengagement members which act to ensure that the squib connector is properly secured within a mating receptacle in a locked position.

2. Discussion of the Background

Connectors, such as automobile airbag squib connectors which utilize plastic connector housings, are widely used. in the automotive industry. Squib connectors are generally used to connect sensors at remote areas of the automobile to the detonation device of an airbag. Normally, three different piece-types are used in the construction of a squib connector housing including a lock section 16 shown in FIG. 1. A molded plastic airbag squib connector housing 10 is depicted with a bottom section 12, a top cover section 14 and a lock section 16. Mounted underneath the bottom section 12 is a male insert 38 and two holding pins 40. The male insert 38 is located between the two locking pin access slots 36. Conversely, the two holding pins 40 are mounted adjacent to the locking pin access slots 36 on both sides of the male insert 38. Attached along one side of the male insert 38 is a key 42. Furthermore, located on the end of the male insert 38 is a first male pin receiving port 44 and a second male pin receiving port 46.

Turning to FIG. 2, extending from the first male pin receiving port 44 to the first recess 29 is a first bore 48. Similarly, although not shown, is a second bore extending from the second male pin receiving port to the second female contact mounting recess. The bottom section 12 includes first chamber 22, second chamber 24, third chamber 26, reinforcement cavity 27, U-shaped chamber access slots 28, first recess 29, access slots 33, indented portion 66 and lip 50 of pin 40. Referring now to FIG. 3, on the end of each of the holding pins 40 is a lip 50. Each lip 50 extends outwardly and away from the male insert 38 for the purpose of retention in a mating receptacle.

Referring again to FIG. 1, the top cover section 14 has an indented portion 66 which is adapted to accommodate the lock section 16. During the molding process, the top cover section 14 is connected to the lock section 16. The lock section 16 has a base 68 and a head 70 which together form a T-shape. On the head 70 of the lock section 16 are two locking pins 72. Snapping the sections of the squib connector housing 10 together is accomplished by bending the molding runners 52 so that the top cover mounting pins 58 align with the top cover mounting slots.

The lock section 16 is utilized in order to secure the connector to a receptacle by preventing the squib connector holding pins 40 of the bottom section 12 from bending inwardly toward the male insert 38. When the top cover section 14 is mounted on the bottom section 12, the locking pins 72 of the lock section 16 are inserted within the access holes 54 of the top cover section 14. The lock section 16 is then pressed against the top cover section 14 so that the base 68 and the head 70 of the lock section fits within the indented portion 66 of the top cover section. Pressing the lock section 16 onto the top cover section 14 will cause the lock section locking pins 72 to extend through the locking pin access slots 36 of the bottom section 12. Thus, the locking pins 72 will occupy the space between the male insert 38 and the holding pins 40. Furthermore, the bending of the locking section 16 onto the top of the top cover section 14 will result in the locking section either bending or breaking from the top cover section 14 in the area of notch 74.

Once fully assembled, the squib connector housing 10 may be connected to an airbag detonator receptacle by insertion of the male insert 38. When the male insert 38 is connected, male contact pins from the airbag detonator will extend within the first male pin receiving port 44 and the second male pin receiving port 46. The male contact pins will form an electrical connection with corresponding female contacts mounted within the bottom section 12. The connector housing is held within the detonator via the holding pins 40 which are maintained in their locked position via pressure of the locking pins 72 against the holding pins so that lip 50 remains engaged to the walls of the detonator. Use of the locking pins 72 and the head 70 requires a two-step process to secure the connector 10 to the detonator. The holding pins 40 must be inserted in one step and the locking pins 72 inserted in another step. Further, it may be seen that upon insertion of the connector to the receptacle, the lip 50 of the holding pin 40 fictionally engages the opening of the receptacle requiring a high insertion force of the connector into the receptacle.

To address the problems associated with the connectors discussed above, U.S. Pat. No. 5,529,512 provides a connector having a locking mechanism which can be secured to a receptacle in a single motion by applying a low insertion force.

However, problems may arise due to disengagement of the commonly known and used squib connectors from within the receptacle after assembly thereof. If the squib connector is not properly seated or attached in a locked position, the squib connector can easily disengage from the receptacle during use. For example, the vibrations of a moving automotive vehicle can cause a squib connector to disengage that was not properly and fully attached to the receptacle.

A need, therefore exists, to provide a squib connector that effectively eliminates disengagement thereof from a receptacle during use, such as during use as an airbag squib connector of an automotive vehicle.

SUMMARY OF THE INVENTION

The present invention provides electronic connectors that include disengagement members which act to ensure that the squib connector is in a locked position within a receptacle after assembly thereof. The electrical connectors of the present invention can be utilized in a variety of different applications, such as those relating to automotive airbag squib connectors. In this regard, the squib connectors of the present invention can be properly attached within mating receptacles in the locked position. This effectively eliminates disengagement of the electrical connector from the receptacle during use.

To this end, in an embodiment of the present invention, an electrical connector is provided. The electrical connector includes a housing with contacts for electrically connecting to a mating receptacle, a disengagement member attached to the housing and a locking mechanism that engages the housing for securing the electrical connector within the receptacle. The disengagement member acts to disengage the electrical connector from the receptacle unless the locking mechanism is in a locked position.

In another embodiment, an airbag squib connector is provided. The airbag squib connector includes a housing with contacts for electrically connecting within a mating receptacle; a locking mechanism that includes a latch member having a deflector pin and a locking member wherein the; locking mechanism slidably engages the housing for securing the housing within the receptacle in a locked position; and a disengagement member attached to the housing that compresses against the receptacle when the squib connector is secured within the receptacle wherein the disengagement member disengages the squib connector from the receptacle unless the locking mechanism is in the locked position.

In yet another embodiment, a method of securing an electrical connector within a receptacle is provided. The method includes the steps of providing the electrical connector with a locking mechanism and a disengagement member; inserting the electrical connector into the receptacle; and compressing the disengagement member against the receptacle for disengaging the electrical connector from the receptacle until the locking mechanism is in a locked position.

It is, therefore, an advantage of the. present invention to provide electrical connectors that include disengagement members.

Another advantage of the present invention is to provide electrical connectors that utilize disengagement members to ensure that the electrical connectors are attached to mating receptacles in a locked position.

A further advantage of the present invention is to provide electrical connectors that include disengagement members which can be manufactured at reduced cost and which can be readily attached within mating receptacles to ensure that the electrical connectors are securely attached in a locked position.

Yet another advantage of the present invention is to provide electrical connectors for use as automotive airbag squib connectors which effectively eliminate disengagement of the squib connectors from mating receptacles during use thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4A illustrates a top view showing the housing with contacts. FIG. 4B illustrates a top view showing the position of the disengagement member relative to the housing;

FIG. 5A illustrates a side sectional view showing the locking members of the locking mechanism taken along Line 5—5 of FIG. 4A. FIG. 5B illustrates a side sectional view showing the locking members relative to the deflection pins taken along Line 5—5 of FIG. 4A. FIG. 5C illustrates a side view showing the disengagement member; FIG. 6A illustrates a side sectional view showing the locking members taken along Line 5—5 of FIG. 4A. FIG. 6B illustrates a side sectional view showing the locking members relative to the contacts taken along Line 5—5 of FIG. 4A. FIG. 6C illustrates a. side view showing the latch member and disengagement member.

DETAILED DESCRIPTION OF THE PRESENTLY PREFERRED EMBODIMENTS

The present invention provides electrical connectors that utilize disengagement members to ensure that the electrical connectors are properly secured within mating receptacles in a locked position. The electrical connectors of the present invention can be utilized in a variety of different applications. In particular, the electrical connectors are utilized as automotive airbag squib connectors. In this regard, the squib connectors of the present invention utilize disengagement members to ensure that the squib connectors are properly attached to mating receptacles during assembly thereof. This effectively eliminates disengagement of the squib connectors from the receptacles during use.

The electrical connectors of the present invention can include a variety of different components of varying sizes, shapes and material make-ups. In a preferred embodiment, the electrical connector of the present invention includes a disengagement member that is attached to a housing of an electrical connector. The disengagement member is utilized to effectively eliminate disengagement of the electrical connector from within a mating receptacle during use, such as during use as an airbag squib connector of an automotive vehicle. If the connector, namely, the locking mechanism thereof, is not securely attached within the mating receptacle in a locked position, the connector may disengage therefrom during use due, for example, to vibrations of a moving automotive vehicle.

The disengagement member can be utilized with any suitable electrical connector. In a preferred embodiment, the disengagement member is utilized with the electrical connector of U.S. Pat. No. 5,529,512 which is hereby incorporated herein by reference.

Figure 1:
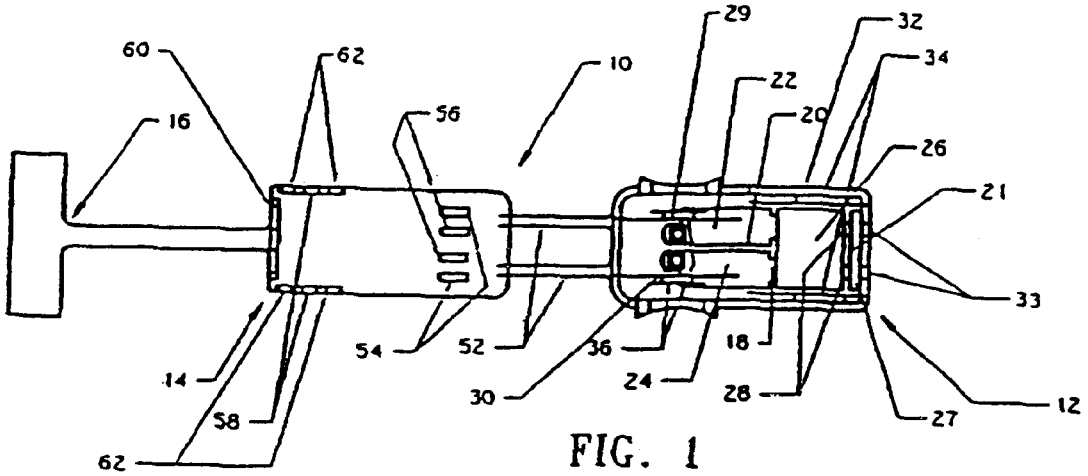
FIG. 1 PRIOR ART
FIG. 1 illustrates a bottom view of a connector housing of the prior art.
Figure 2:
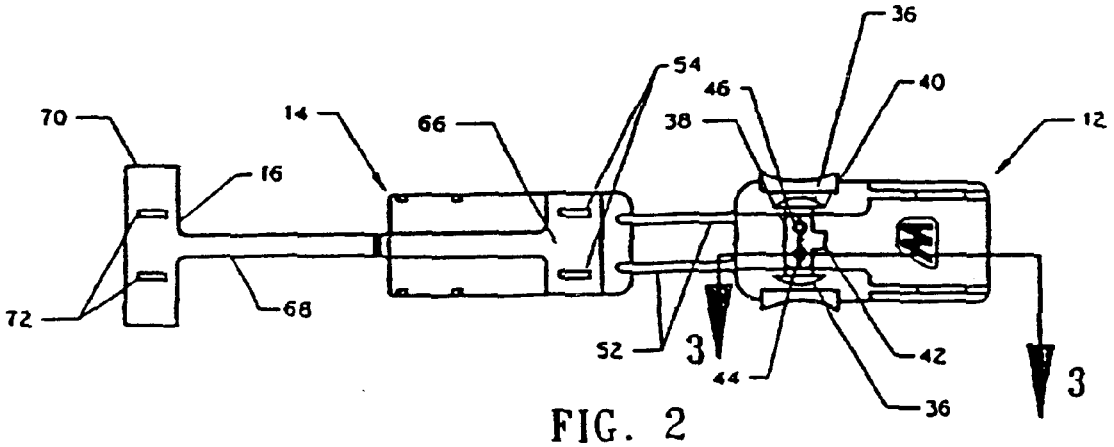
FIG. 2 PRIOR ART
FIG. 2 is a side view of the connector housing of the prior art of FIG. 1.
Figure 3:
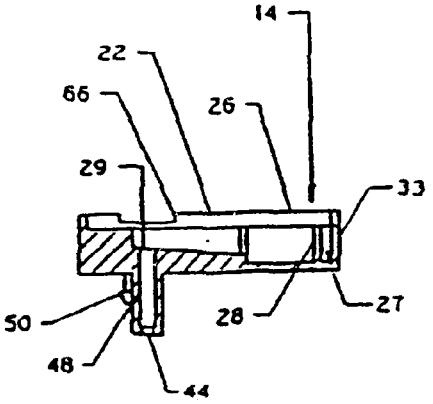
FIG. 3 PRIOR ART
FIG. 3 is an end view of an assembled connector of the prior art taken along Line 3—3 of FIG. 2.
Figure 4A:
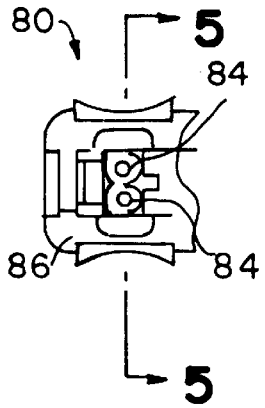
FIGS. 4A and 4B illustrate top views of the electrical connector of the present invention.
Figure 4B:
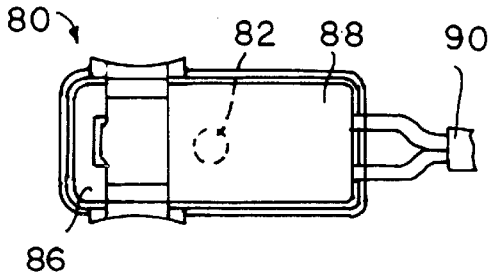

Turning to FIGS. 4A, 4B, 5A, 5B, 5C, 6A, 6B, and 6C, the electrical connector 80 which includes a disengagement member 82 is preferably illustrated. As shown in FIG. 4B, the disengagement member 82 is positioned adjacent to the contacts 84 of the housing 86 along a region of an arm member 88 which extends from the housing 86. The arm member 88 can provide electrical connection to a power supply 90 of the connector 80 as shown in FIG. 4B. It should be appreciated that the disengagement member 82 can be located in any suitable position such that it can properly function to disengage the connector .80 if the connector 80 is not properly attached in a locked position within a mating receptacle.

Figure 5A:
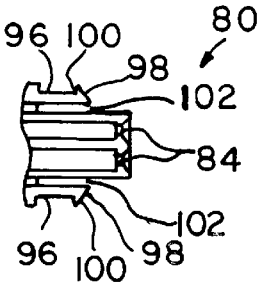
FIGS. 5A, 5B, and 5C illustrate side views of the connector of the present invention in an installed state.
Figure 5B:
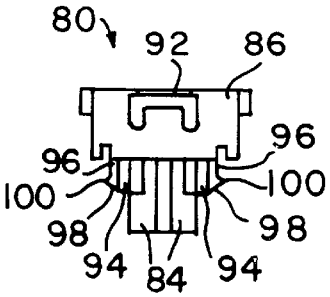
Figure 5C:
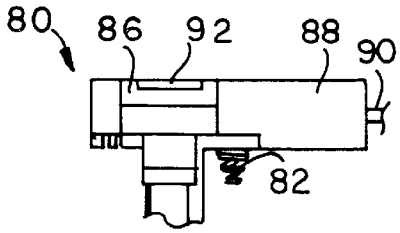
Figure 6A:
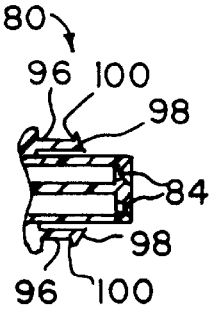
FIGS. 6A, 6B, and 6C illustrate side views of the electrical connector of the present invention in an uninstalled state.
Figure 6B:
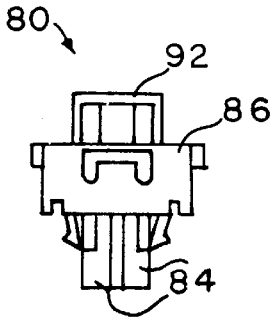
Figure 6C:
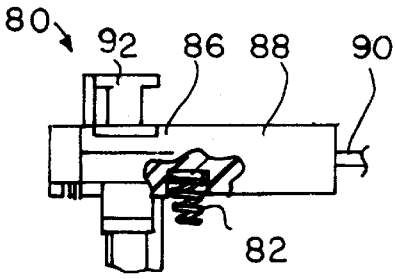

In a preferred embodiment, the disengagement member 82 includes a spring member as illustrated in FIGS. 5C and 6C. The spring member can include any suitable material, preferably metal. The spring member is attached to the housing 86 by any suitable way such that a portion of the spring extends from the housing 86 in order to compress against the receptacle (not shown) when the connector 80 is inserted therein.

It should be appreciated that the disengagement member 82 can include a variety of shapes, sizes and material make-ups. The type and positioning of the disengagement member 82 is limited to the extent that it can properly disengage the connector 80 from the mating receptacle if the connector 80 is not secured in a locked position.

In an alternate embodiment, the disengagement member 82 can include a rubber or elastomeric member. The rubber member preferably includes a rubber O-ring which is attached to the housing such that it extends therefrom. The O-ring is positioned relative to the housing such that its opening surrounds the contacts of the connector.

As previously discussed, the disengagement member 82 is preferably utilized with an electrical connector which is disclosed in U.S. Pat. No. 5,529,512. In this preferred embodiment, the electrical connector 80 includes a housing 86 with a pair of contacts 84 for electrically connecting to a mating receptacle. The electrical connector further includes a locking mechanism that slidably engages the housing 86 for securing the connector 80 in a locked position within the mating receptacle, as illustrated in FIGS. 5A, 5B, 5C, 6A, 6B, and 6C. The locking mechanism includes a latch member 92 having a deflector pin 94 and a locking member 96, each coupled to the latch member 92. The locking member 96 includes a head 98 with a detent 100 for engaging a lip of the mating receptacle.. This secures: the electrical connector 80 in a locked position when the connector and mating receptacle are assembled.

The deflector pins 94 are located within a gap 102 between the housing 86 and the locking member 96. By sliding the latch member 92 from an uninstalled (FIGS. 6A, 6B, 6C) to an installed position (FIGS. 5A, 5B, 5C), the deflection pins 94 displace the locking members 96 to the locking position such that the locking member 96 is securely attached to the lip of the mating receptacle.

During assembly, the disengagement member 82 compresses against a surface of the mating receptacle as the connector is inserted within the mating receptacle. If the locking members 96 are not secured in the locked position, the compression force of the disengagement member 82 disengages the connector 80 from the receptacle. This ensures that the assembly of the connector 80 and receptacle is not complete until the connector 80 is secured within the receptacle in the locked position. In this regard, the retention force of the locked position is greater than the compression force exerted by the disengagement member such that the connector remains securely locked or attached to the mating receptacle.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that all such changes and modifications be covered by the appended claims.

What is claimed is:

1. An electrical connector comprising:

a housing having contacts for electrically connecting to a mating receptacle and an arm member attached adjacent the contacts, the arm member having a power supply connection;

a disengagement member attached to the arm member spaced apart from the contacts; and a locking mechanism that engages the receptacle for securing the electrical connector within the receptacle wherein the disengagement member acts to disengage the electrical connector from a completely mated position within the mating receptacle unless the locking mechanism is in a locked position.

2. The electrical connector of claim 1 wherein the disengagement member includes a compressible member.

3. The electrical connector of claim 2 wherein the compressible member is a spring.

4. The electrical connector of claim 2 wherein the compressible member is a rubber material that surrounds the contacts of the housing.

5. The electrical connector of claim 1 wherein the disengagement member compresses against the receptacle as the electrical connector is inserted within the mating receptacle.

6. The electrical connector of claim 1 wherein the locking mechanism includes a latch member having a deflection pin and a locking member.

7. The electrical connector of claim 1 wherein the locking mechanism includes a pair of deflector pins and a pair of locking members.

8. The electrical connector of claim 6 wherein the deflector pin slides within a gap between the locking member and the housing for engaging the locking member with a lip of the mating receptacle; thereby securing the electrical connector in the locked position.

9. The electrical connector of claim 1 wherein the mating receptacle is an airbag detonator receptacle.

10. An airbag squib connector comprising:

a housing have contacts for electrically connecting within a receptacle; and an arm member attached adjacent the contacts, the arm member having a power supply connection;

a locking mechanism including a latch member having a deflector pin and a locking member wherein the locking mechanism slidably engages the receptacle for securing the housing within the receptacle in a locked position; and a disengagement member attached to the arm member that compresses against the receptacle when the airbag squib connector is inserted within the receptacle wherein the disengagement member disengages the squib connector from the receptacle unless the locking mechanism is in the locked position.

11. The airbag squib connector of claim 10 wherein the disengagement member is a spring member.

12. The airbag squib connector of claim 10 wherein the disengagement member is a rubber member.

13. The airbag squib connector of claim 10 wherein the disengagement member is a rubber O-ring.

14. The airbag squib connector of claim 10 wherein the locking member includes a detente for engaging a lip of the receptacle in the locked position.

15. The airbag squib connector of claim 10 wherein the locking mechanism includes a pair of locking members and a pair of deflector pins.

16. A method of securing an electrical connector within a receptacle comprising the steps of:

providing the electrical connector with a locking mechanism and a disengagement member mounted on an arm member having a power supply connection;

inserting the electrical connector into a receptacle and the arm member being located adjacent a housing portion of the receptacle; and compressing the disengagement member against the housing portion of the receptacle for disengaging the electrical connector from the receptacle until the locking mechanism is in a locked position and;

supplying current to the receptacle via the power supply connection when the connector is in the locked position.

17. The method of claim 16 wherein the disengagement member includes a spring member or a rubber member.

18. The method of claim 16 wherein the electrical connector includes an airbag squib connector.

19. The method of claim 16 wherein the disengagement member includes a rubber O-ring.

20. The method of claim 16 wherein the locking mechanism when in a locked position provides a retention force that is greater than a force exerted by the disengagement member.

* * * * *